US008894782B2

(12) United States Patent
Dobbins et al.

(10) Patent No.: US 8,894,782 B2
(45) Date of Patent: Nov. 25, 2014

(54) HYPERGOLIC HYDROCARBON FUELS

(75) Inventors: Thomas A. Dobbins, Howard, OH (US); David B. Wiley, Warsaw, OH (US)

(73) Assignee: Wiley Organics, Inc., Coshocton, OH (US)

( * ) Notice: Subject to any disclaimer, the term of this patent is extended or adjusted under 35 U.S.C. 154(b) by 168 days.

(21) Appl. No.: 10/365,102

(22) Filed: Feb. 12, 2003

(65) Prior Publication Data

US 2014/0209224 A1 Jul. 31, 2014

Related U.S. Application Data

(60) Provisional application No. 60/407,888, filed on Sep. 3, 2002, provisional application No. 60/421,370, filed on Oct. 25, 2002.

(51) Int. Cl.
*C06B 21/00* (2006.01)
*C06B 47/00* (2006.01)
*C06B 43/00* (2006.01)

(52) U.S. Cl.
CPC ..... *C06B 43/00* (2013.01)
USPC ..... 149/1; 149/109.6

(58) Field of Classification Search
CPC ..... C06B 21/00; C06B 47/00
USPC ..... 585/14; 149/1, 109.6
See application file for complete search history.

(56) References Cited

U.S. PATENT DOCUMENTS

| | | | | |
|---|---|---|---|---|
| 2,693,077 | A | 11/1954 | Malina et al. | |
| 3,622,367 | A * | 11/1971 | Haag et al. | 427/212 |
| 3,652,241 | A * | 3/1972 | Bialy et al. | 44/387 |
| 4,316,359 | A | 2/1982 | Sayles | |
| 5,076,813 | A | 12/1991 | Alberici et al. | |
| 5,433,802 | A | 7/1995 | Rothgery et al. | |
| 5,616,882 | A | 4/1997 | Nichols et al. | |
| 5,621,156 | A | 4/1997 | Thompson | |
| 5,932,837 | A | 8/1999 | Rusek et al. | |
| 6,013,143 | A | 1/2000 | Thompson | |
| 6,072,094 | A * | 6/2000 | Karady et al. | 585/538 |
| 6,073,437 | A | 6/2000 | Jones | |
| 6,254,705 | B1 | 7/2001 | Anflo et al. | |
| 6,272,846 | B1 | 8/2001 | Schneider | |
| 6,288,297 | B1 * | 9/2001 | Wang et al. | 585/538 |
| 6,311,477 | B1 | 11/2001 | Schneider | |
| 6,419,771 | B1 | 7/2002 | Lormand | |
| 2003/0015268 | A1 * | 1/2003 | Dobbins et al. | 149/109.4 |

OTHER PUBLICATIONS

Luk'yanova et al., Chem. Abs., Abs. No. 117:221141, (1992), abstract of "Zhurnal Fizicheskoi Chimii" (1992), 66(8), 2031-5.*
Kotel'nikova et al., Chem. Abs., Abs. No. 116:40820, (1991), abstract of "Vestnik Moskovskogo Universiteta, Seriya 2: Kihimiya" (1991), 32(3), 237-41.*
Pimenova et al., Chem. Abs., Abs. No. 108:211429, (1986), abstract of "Termodinam. Organ. Soed., Gor'kii" (1986) 12-16.*
Hurlbert, E. et al., "Nontoxic Orbital Maneuvering and Reaction Control Systems for Reusable Spacecraft," *Journal of Propulsion and Power*, vol. 14, No. 5 (Sep.-Oct. 1998).
Walls, T. et al., "Performance and Safety Aspects of Monopropellant and Non-Toxic Bipropellant Liquid Divert/ACS Propulsion for Navy TBMD Applications,"2nd Annual AIAA SDIO Interceptor Technology Conference, Albuquerque, NM (Jun. 1993).

* cited by examiner

*Primary Examiner* — Aileen B Felton
(74) *Attorney, Agent, or Firm* — Thompson Hine L.L.P.

(57) ABSTRACT

Reduced toxicity fuels containing hydrocarbons having both strained rings and internal, conjugated triple bonds are disclosed. The fuels described herein are hypergolic with nitrogen tetroxide and/or inhibited red fuming nitric acid.

24 Claims, No Drawings

HYPERGOLIC HYDROCARBON FUELS

CROSS REFERENCE TO RELATED APPLICATIONS

This application claims priority from U.S. Provisional Application Ser. No. 60/407,888, filed Sep. 3, 2002 and U.S. Provisional Application No. 60/421,370 filed Oct. 25, 2002.

BACKGROUND OF THE INVENTION

The present invention is related to reduced toxicity fuels, and more particularly, to reduced toxicity fuels containing hydrocarbons having both strained rings and internal, conjugated triple bonds. The disclosed fuels are hypergolic with nitrogen tetroxide and in some cases with inhibited red fuming nitric acid as well.

Hypergolic propellants are combinations of fuels and oxidizers that ignite spontaneously upon contact with one another and require no ignition source. The extremely rapid, reliable start and re-start capability of hypergolic propellants make them ideal for spacecraft maneuvering systems. In addition, since hypergolic propellants remain liquid at ordinary temperatures, they do not pose the storage problems of cryogenic propellants.

The hypergolic fuels currently in widespread use are highly toxic and must be handled with extreme care. Examples of these fuels include hydrazine, monomethylhydrazine (MMH) and unsymmetrical dimethylhydrazine (UDMH). The oxidizers typically used with these fuels to provide a hypergolic bipropellant system include nitrogen tetroxide ($N_2O_4$) and nitric acid ($HNO_3$). UDMH is used in many Russian, European, and Chinese rockets, while MMH is used in the orbital maneuvering system (OMS) and reaction control system (RCS) of the Space Shuttle orbiter. The Titan family of launch vehicles and the second stage of the Delta rocket use a fuel called Aerozine 50, a mixture of 50% UDMH and 50% hydrazine.

Drawing on the German Wasserfall rocket of World War II, nitric acid ($HNO_3$) became the early storable oxidizer of choice for missiles and upper stages during the 1950's. To overcome various problems with its use, it was necessary to combine nitric acid with nitrogen tetroxide ($N_2O_4$) and various passivating agents that protect metal tanks and engine components from corrosion (typically small amounts of hydrogen fluoride or free halogens). The presence of these passivating corrosion inhibitors was denoted by the designation "inhibited red fuming nitric acid," which is commonly referred to by its acronym, "IRFNA." Unreliable ignition and unstable combustion led to the abandonment of many early propellant combinations, but the combination of IRFNA and UDMH did finally prove satisfactory.

The compositions of propellant-grade nitric acids are described by Military Specification MIL-N-7254. They are all fuming liquids with a density of about 1.5 grams per cubic centimeter and vary in appearance from colorless to dark brown, depending on the amount of dissolved $N_2O_4$. The vapors from these acids have a characteristic pungent odor. They are highly corrosive, oxidizing agents that attack most metals and react with some organic materials with sufficient vigor to cause fire. These acids are miscible with water in all proportions (with accompanying evolution of heat) and cannot be made to explode. Approximately 90 percent of the nitric acid is made by the catalytic oxidation of ammonia with air or oxygen to yield nitric oxide (NO). The latter is oxidized to $N_2O_4$ which, when treated with water, yields nitric acid ($HNO_3$) and may be concentrated by distillation with sulfuric acid. Red fuming nitric acids can be also prepared by passing gaseous $N_2O_4$ into nitric acid.

By the late 1950's it was apparent that nitrogen tetroxide by itself was a better oxidizer, and nitric acid was largely supplanted by pure $N_2O_4$ in storable liquid fuel rocket engines developed after 1960. Nitrogen tetroxide consists principally of $N_2O_4$ in equilibrium with a small amount of nitrogen dioxide ($NO_2$). The purified grade contains less than 0.1 percent water and has a density of 1.45 grams per cubic centimeter. Nitrogen tetroxide boils at 21° C. and has a characteristic reddish-brown color in both the liquid and gaseous phases; the solid phase (melting point −11° C.) is colorless. $N_2O_4$ has an irritating, acrid, acid-like odor and is a very reactive oxidizing agent. Although it is non-flammable with air, it will inflame many combustible materials. It is not sensitive to mechanical shock, heat, or detonation. Commercially, nitrogen dioxide is produced by the catalytic oxidation of ammonia. Steam is used as a diluent to reduce the combustion temperature. Most of the water is condensed out and the gases are further cooled; the nitric oxide is oxidized to nitrogen dioxide, and the remainder of the water is removed as nitric acid. The gas is essentially pure nitrogen tetroxide, which is condensed in a brine-cooled liquefier.

Monomethylhydrazine ($CH_3NHNH_2$) is a storable liquid fuel that found favor in the United States for use in orbital spacecraft engines. Its advantages in comparison to UDMH are higher density and slightly higher performance. Monomethylhydrazine (MMH) is a clear, water-white hygroscopic liquid with a density of 0.88 grams per cubic centimeter that freezes at −52° C. and boils at 87° C. It tends to turn yellow upon exposure to air. MMH is a toxic, volatile liquid that reacts with carbon dioxide and oxygen. It has the typical sharp ammoniacal or fishy odor of amines, and is highly toxic.

Unsymmetrical dimethylhydrazine (1,1-dimethylhydrazine; $(CH_3)_2NNH_2$) became the storable liquid rocket fuel of choice by the mid-1950's. Generally known by its acronym "UDMH," it is used in virtually all storable liquid rocket engines except for some orbital maneuvering engines in the United States, where MMH has been preferred due to its slightly higher density and performance. Unsymmetrical dimethylhydrazine of 98 to 99% purity is described by Military Specification MIL-D-25604. It is a clear, hygroscopic liquid with a density of 0.79 grams per cubic centimeter that freezes at −57° C. and boils at 63° C. Like monomethylhydrazine, it exhibits the sharp ammoniacal or fishy odor characteristic of organic amines.

Both unsymmetrical dimethylhydrazine and monomethylhydrazine are confirmed animal carcinogens that have been characterized as tumorigenic, mutagenic, reproductive effectors. The Occupational Safety and Health Administration (OSHA) limits permissible exposure to only 0.5 parts per million (1 milligram per cubic meter) on an eight hour time-weighted average.

This extreme toxicity and the associated difficulties and expense of transporting and handling these compounds have produced widespread interest in finding replacement fuels. This search is the subject of ongoing formal programs conducted both by NASA and various branches of the US military.

U.S. Pat. No. 2,693,077 to Malina et al., discloses fuels spontaneously combustible with oxidizing agents like red fuming nitric acid. Among the fuels described as being useful are liquid hydrocarbons containing a large fraction of unsaturated carbon bonds. The only specific examples cited are divinyl acetylene, dipropargyl, and propargyl alcohol. However, divinyl acetylene is an extremely hazardous substance due to its thermal instability, shock sensitivity, and tendency to spontaneously polymerize, forming a resin that explodes when handled. Dipropargyl(dipropinyl or 1,5-hexadiyne), isomeric with benzene, is a flammable, pungent-smelling mobile liquid that is thermally unstable. Propargyl alcohol (2-propyn-1-ol) is flammable, toxic, a suspected carcinogen, and also tends to polymerize.

U.S. Pat. No. 6,272,846 to Schneider discloses that: "Reduced-toxicity fuels have not been used in the past, due to the fact that candidate fuels are not hypergolic. In other words, liquid reduced toxicity fuels will not spontaneously react with an oxidizer to begin the combustion process as in prior art fuels such as hydrazine." Likewise, U.S. Pat. No. 6,311,477 to Schneider again notes: "Unfortunately . . . reduced toxicity propellants suitable for use with satellite propulsion are not hypergolic."

SUMMARY OF THE INVENTION

The present invention is related to reduced toxicity fuels, and more particularly, to reduced toxicity fuels containing hydrocarbons having both strained rings and internal, conjugated triple bonds. The disclosed fuels are hypergolic with nitrogen tetroxide and in some cases with inhibited red fuming nitric acid as well.

The hydrocarbons useful in the present invention include compounds having the formula (I):

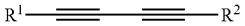

(I)

where $R^1$ and $R^2$ are the same or different and represent an alkyl group having from 1 to 5 carbon atoms, provided at least one of $R^1$ and $R^2$ represents a cycloalkyl group having from 3 to 4 carbon atoms. These compounds are hypergolic with oxidizers selected from the group consisting of nitrogen tetroxide and inhibited red fuming nitric acid. Furthermore, these hydrocarbons can be mixed with non-hypergolic fuels such as kerosene (RP-1) and exo-tetrahydro-dicyclopentadiene (JP-10) to form hypergolic rocket fuel mixtures.

In accordance with another aspect of the present invention, a fuel composition comprising a compound represented by formula (I) is described wherein the fuel composition is hypergolic when brought into contact with an oxidizer such as nitrogen tetroxide or inhibited red fuming nitric acid.

In accordance with another aspect of the present invention, a propellant comprising a fuel composition and an oxidizer wherein the fuel composition comprises a compound represented by formula (I) and the oxidizer is selected from the group consisting of nitrogen tetroxide and inhibited red fuming nitric acid is disclosed.

In yet another aspect of the present invention, a method for producing a propellant is provided. The disclosed method comprises contacting a fuel with an oxidizer wherein the fuel comprises a compound represented by a formula (I) and the oxidizer is selected from the group consisting of nitrogen tetroxide and inhibited red fuming nitric acid.

DETAILED DESCRIPTION OF THE INVENTION

All documents cited are, in relevant part, incorporated herein by reference; the citation of any document is not to be construed as an admission that it is prior art with respect to the present invention.

It has been found that the structural characteristics of certain reduced-toxicity hydrocarbons, namely strained rings and conjugated, internal triple bonds, promote hypergolicity with nitrogen tetroxide and IRFNA.

The dramatic difference in reactivity between the terminal acetylene 1-pentyne, which is not hypergolic with nitrogen tetroxide or IRFNA, and ethynylcyclopropane (cyclopropylacetylene), a 5-carbon terminal acetylene containing a strained ring, that is vigorously hypergolic with both nitrogen tetroxide and IRFNA, demonstrates that the presence of a strained ring like the cyclopropyl ring favors hypergolicity. The behavior of 1-pentyne proved to be characteristic of other simple terminal acetylenes; 1-hexyne and 1-octyne also failed to ignite with nitrogen tetroxide or IRFNA.

The dramatic difference in reactivity between the structural isomer pairs 1,7-octadiyne and 3,5-octadiyne and 1,9-decadiyne and 2,4-decadiyne demonstrates that internal, conjugated diacetylenes favor hypergolicity more than terminal diacetylenes.

These discoveries suggest that the ideal hypergolic hydrocarbon fuels will contain both strained rings and internal, conjugated triple bonds. Accordingly, hydrocarbons having the formula (I):

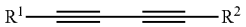

(I)

where $R^1$ and $R^2$ are the same or different and represent an alkyl group having from 1 to 5 carbon atoms, provided at least one of $R^1$ and $R^2$ represents a cycloalkyl group having from 3 to 4 carbon atoms are particularly useful as hypergolic hydrocarbon fuels.

In accordance with certain embodiments of the present invention, the hypergolic hydrocarbon fuels are represented more specifically by the formula (I):

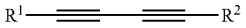

(I)

where $R^1$ and $R^2$ are the same or different and represent a cycloalkyl group having from 3 to 4 carbon atoms.

Specific examples of compounds in accordance with the present invention include, without limitation, the following:

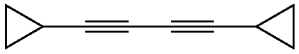

1,4-dicyclopropyl-1,3-butadiyne

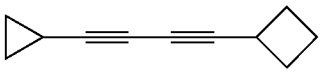

1-cyclobutyl-4-cyclopropyl-1,3-butadiyne

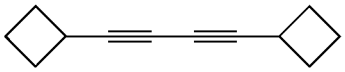

1,4-dicyclobutyl-1,3-butadi-yne

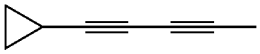

1-methyl-4-cyclopropyl-butadi-yne

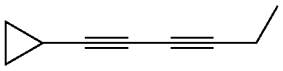

1-ethyl-4-cyclopropyl-butadi-yne

Economical and facile methods of synthesizing these compounds from readily available precursors are described in commonly assigned U.S. Provisional Application Ser. No. 60/400,258, entitled "PREPARATION OF SUBSTITUTED DIYNES BY OXIDATIVE COUPLING OF SUBSTITUTED ACETYLENES".

These compounds typically are colorless to pale yellow high-boiling liquids with a high degree of thermal stability. They preferably are freely miscible with both polar and non-polar organic fuels. The reduced-toxicity hydrocarbons of the present invention can be used in a range from about 25-100%, more particularly 40% to 100% by weight of the total fuel composition. Examples of fuels that can be used with the reduced-toxicity hydrocarbons described herein include saturated hydrocarbons (e.g., hexane, heptane, octane, decane, gasoline, kerosene), unsaturated hydrocarbons (e.g., ethylene, propylene, butadienes), alcohols (e.g., methanol, ethanol, propanol), organoamines and hydrazines. The concentration ranges of hypergolic fuels based on the present invention that are required to maintain hypergolicity in fuel mixtures containing other polar and non-polar fuels can be readily determined experimentally.

The oxidizer-to-fuel ratio is typically selected to produce combustion products with minimal molecular weights in order to maximize specific impulse. Mass ratios of oxidizer-to-fuel will typically range from 2:1 to 10:1.

The reduced-toxicity hydrocarbons of the present invention offer a number of properties that are far more desirable than those of the hypergolic fuels currently in widespread use, monomethylhydrazine and unsymmetrical dimethylhydrazine:

- They are minimally toxic and form combustion products of low molecular weight (with the proper fuel-to-oxidizer ratios) that are non-toxic or minimally toxic.
- They have high flash points and are combustible but not flammable. They will not alter the transportation and handling characteristics of conventional hydrocarbon fuels like RP-1 or JP-10 if they are employed as performance-enhancing additives. By contrast, both unsymmetrical dimethylhydrazine (UDMH) and monomethylhydrazine (MMH) are highly flammable. Unsymmetrical dimethylhydrazine (boiling point 63° C.) has a flash point of 5° F. and forms flammable mixtures with air over a wide range of 2% to 95%. Monomethylhydrazine (boiling point 87° C.) has a flash point of 70° F. and forms flammable mixtures with air over a wide range of 2.5% to 98%. By contrast, 1,4-dicyclopropyl-1,3-butadiyne has a boiling point in excess of 400° F. at a pressure of 760 mm Hg (>92° C. @ 0.5 mm Hg) and a flash point in excess of 140° F. 1-Cyclobutyl-4-cyclopropyl-butadiyne and 1,4-diyclobutyl-butadiyne are even higher boiling and have correspondingly higher flash points. All of these compounds are combustible, but they are not flammable.
- A comparatively high specific gravity of 0.91 versus 0.79 for unsymmetrical dimethylhydrazine and 0.88 for monomethylhydrazine. High specific gravity values correspond to the high density specific impulse values desirable in rocketry.
- The combination of strained rings and the high degree of unsaturation due to the presence of conjugated triple bonds provide high bond energies that correspond to high heats of formation. These characteristics in turn correspond to high specific impulse values in rocket fuels.

The present invention is illustrated in more detail by the following non-limiting examples.

Example 1

Nitrogen tetroxide ($N_2O_4$) was prepared by adding a mixture of 9 parts by volume ACS reagent grade concentrated nitric acid (nominally 90% $HNO_3$) and 1 part by volume concentrated sulfuric acid to short lengths of 20-gauge copper wire placed in a three-necked flask equipped with an addition funnel and a Liebig condenser. The reddish-brown gaseous $NO_2$ that was evolved was collected as a dark fuming liquid in a receiver immersed in a bath of ice water. Additional material was collected (in the form of white solids that yielded a dark blue-green liquid upon melting) in a second receiver immersed in a dry ice-acetone slurry.

Hypergolicity was evaluated using a porcelain spot plate. To avoid spurious results introduced by the condensation of atmospheric water vapor, these tests were under conditions of low relative humidity. A single drop of the test compound was dispensed using an eyedropper into each of five wells. The bottle containing nitrogen tetroxide (b.p. 21° C.) was chilled in an ice bath, and the eyedroppers used to dispense the nitrogen tetroxide were kept chilled in a beaker containing pellets of dry ice. A single drop of the chilled liquid nitrogen tetroxide was allowed to fall onto one drop of the test compound from a height of approximately five centimeters. Each test was repeated a minimum of six times with every compound under evaluation.

| Test Compound | Result |
|---|---|
| 1-Pentyne (1) | Very mild effervescence after 10 seconds |
| 1-Hexyne (1) | Very mild effervescence after 10 seconds |
| 1-Octyne (1) | Very mild effervescence after 15 seconds |
| 5-Decyne (1) | Effervescent but not hypergolic |
| 1,7-Octadiyne (1) | No visible reaction. |
| 3,5-Octadiyne (1) | Hypergolic, with open flame after 1 to 2 seconds |
| 1,9-Decadiyne (1) | No immediate reaction, but effervescence was observed after a delay of 10 to 15 seconds |
| 2,4-Decadiyne (1) | Hypergolic, with open flame after 2 seconds |
| Ethynylcyclopropane ("ECP" or "Cyclopropylacetylene") (1) | Vigorously hypergolic with open flame and a plume of sooty smoke. |
| 1,4-dicyclopropyl-1,3-butadi-yne ("ECP dimer") (2) | Vigorously hypergolic; audible "pop" and open flame consistently after <0.5 second. |
| 1,4-dicyclobutyl-1,3-butadi-yne ("ECB dimer") (2) | Vigorously hypergolic; open flame consistently after <0.5 second |
| 1-cyclobutyl-4-cyclopropyl-1,3-butadi-yne ("ECP-ECB cross-dimer") (2) | Vigorously hypergolic; open flame consistently after <0.5 second. |

(1) Comparative Example
(2) Invention

Example 2

Red fuming nitric acid was prepared by adding one part by weight nitrogen tetroxide to three parts by weight of ACS reagent grade concentrated nitric acid (nominally 90% $HNO_3$).

Once again, hypergolicity was evaluated using a porcelain spot plate. A single drop of the test compound was dispensed using an eyedropper into each of five wells. A single drop of red fuming nitric acid was allowed to fall onto one drop of the test compound from a height of approximately five centimeters. Each test was repeated a minimum of six times with every compound under evaluation.

| Test Compound | Result |
|---|---|
| 1-Pentyne (1) | No visible reaction |
| 1-Hexyne (1) | No visible reaction |

-continued

| Test Compound | Result |
|---|---|
| 1-Octyne (1) | No visible reaction |
| 5-Decyne (1) | Slowly effervescent |
| 1,7-Octadiyne (1) | No visible reaction |
| 3,5-Octadiyne (1) | No visible reaction. |
| 1,9-Decadiyne (1) | No visible reaction |
| 2,4-Decadiyne (1) | No visible reaction |
| Ethynylcyclopropane ("ECP" or "Cyclopropylacetylene") (1) | Instantaneous, very vigorous exothermic reaction that causes the ECP (b.p. 52° C.) to boil off rapidly. No ignition observed. Given the very rapid onset and vigor of the reaction, it is possible that this combination would be hypergolic at elevated pressures capable of preventing the vaporization of ECP. |
| 1,4-dicyclopropyl-1,3-butadi-yne ("ECP dimer") (2) | Marginally hypergolic, with an open flame after a delay to 1 to 2 seconds in three out of ten attempts. |
| 1,4-dicyclobutyl-1,3-butadi-yne ("ECB dimer") (2) | Not hypergolic. Effervescence observed after a delay of 10 seconds. |
| 1-cyclobutyl-4-cyclopropyl-1,3-butadi-yne ("ECP-ECB cross-dimer") (2) | Not hypergolic. Effervescence observed after a delay of 10 seconds. |

(1) Comparative Example
(2) Invention

The greater reactivity of 1,4-dicyclopropyl-1,3-butadi-yne ("ECP dimer") versus 1,4-dicyclobutyl-1,3-butadi-yne ("ECB dimer") or 1-cyclobutyl-4-cyclopropyl-1,3-butadi-yne ("ECP-ECB cross-dimer") indicates that the cyclopropyl strained ring is more favorable to hypergolicity than the cyclobutyl strained ring.

Example 3

Nitrogen tetroxide ($N_2O_4$) was prepared by adding a mixture of 9 parts by volume ACS reagent grade concentrated nitric acid (nominally 90% $HNO_3$) and 1 part by volume concentrated sulfuric acid to short lengths of 20-gauge copper wire placed in a three-necked flask equipped with an addition funnel and a Liebig condenser. The reddish-brown gaseous $NO_2$ that was evolved was collected as a dark fuming liquid in a receiver immersed in a bath of ice water. Additional material was collected (in the form of white solids that yielded a dark blue-green liquid upon melting) in a second receiver immersed in a dry ice-acetone slurry.

The ability of 1,4-dicyclopropyl-1,3-butadi-yne to remain hypergolic when diluted with varying amounts of various non-hypergolic conventional hydrocarbon fuels was evaluated using a porcelain spot plate. To avoid spurious results introduced by the condensation of atmospheric water vapor, these tests were under conditions of low relative humidity. A single drop of the test mixture was dispensed using an eyedropper into each of five wells. The bottle containing nitrogen tetroxide (b.p. 21° C.) was chilled in an ice bath, and the eyedroppers used to dispense the nitrogen tetroxide were kept chilled in a beaker containing pellets of dry ice. A single drop of the chilled liquid nitrogen tetroxide was allowed to fall onto one drop of the test compound from a height of approximately five centimeters. Each test was repeated a minimum of six times with every compound under evaluation.

| Test Compound | Result |
|---|---|
| Mixture of 80% 1,4-dicyclopropyl-1,3-butadi-yne/20% kerosene | Vigorously hypergolic; audible "pop" and open flame consistently after <0.5 second. |

-continued

| Test Compound | Result |
|---|---|
| Mixture of 75% 1,4-dicyclopropyl-1,3-butadi-yne/25% kerosene | Vigorously hypergolic; audible "pop" and open flame consistently after <0.5 second. |
| Mixture of 67% 1,4-dicyclopropyl-1,3-butadi-yne/33% kerosene | Vigorously hypergolic; audible "pop" and open flame consistently after <0.5 second. |
| Mixture of 50% 1,4-dicyclopropyl-1,3-butadi-yne/50% kerosene | Vigorous reaction, open flame in three of six attempts. |
| Mixture of 80% 1,4-dicyclopropyl-1,3-butadi-yne/20% JP-10 | Vigorously hypergolic; audible "pop" and open flame consistently after <0.5 second. |
| Mixture of 75% 1,4-dicyclopropyl-1,3-butadi-yne/25% JP-10 | Vigorously hypergolic; audible "pop" and open flame consistently after <0.5 second. |
| Mixture of 67% 1,4-dicyclopropyl-1,3-butadi-yne/33% JP-10 | Vigorously hypergolic; audible "pop" and open flame consistently after <0.5 second. |
| Mixture of 50% 1,4-dicyclopropyl-1,3-butadi-yne/50% JP-10 | Vigorous reaction, ignition after a delay of <0.5 seconds on two of six attempts; marginal hypergol at atmospheric pressure. |

What is claimed is:

1. A fuel composition comprising a conventional fuel and a compound represented by the formula (I):

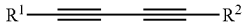

(I)

wherein $R^1$ and $R^2$ are the same or different and represent an alkyl group having from 1 to 5 carbon atoms, provided at least one of $R^1$ and $R^2$ represents a cycloalkyl group having from 3 to 4 carbon atoms, wherein said fuel composition is hypergolic when brought into contact with an oxidizer selected from the group consisting of nitrogen tetroxide and inhibited red fuming nitric acid.

2. The fuel composition of claim 1 wherein said compound is selected from the group consisting of 1-methyl-4-cyclopropyl-butadi-yne and 1-ethyl-4-cyclopropyl-butadi-yne.

3. The fuel composition of claim 1 wherein $R^1$ and $R^2$ are the same or different and represent a cycloalkyl group having from 3 to 4 carbon atoms.

4. The fuel composition of claim 3 wherein said compound is selected from the group consisting of 1,4-dicyclopropyl-1,3-butadiyne, 1-cyclobutyl-4-cyclopropyl-1,3-butadiyne, and 1,4-dicyclobutyl-1,3-butadi-yne.

5. The fuel composition of claim 1 wherein said conventional fuel is selected from the group consisting of saturated hydrocarbons, unsaturated hydrocarbons, alcohols, organoamines, hydrazines and mixtures thereof.

6. The fuel composition of claim 5 wherein said fuel is selected from the group consisting of kerosene and exo-tetrahydro-dicyclopentadiene.

7. A propellant comprising a fuel composition and an oxidizer wherein said fuel composition comprises a compound represented by the formula (I):

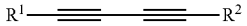

(I)

wherein $R^1$ and $R^2$ are the same or different and represent an alkyl group having from 1 to 5 carbon atoms, provided at least one of $R^1$ and $R^2$ represents a cycloalkyl group having from 3 to 4 carbon atoms and said oxidizer is selected from the group consisting of nitrogen tetroxide and inhibited red fuming nitric acid wherein the fuel composition is hypergolic with the oxidizer.

8. The propellant of claim 7 wherein said compound is selected from the group consisting of 1-methyl-4-cyclopropyl-butadi-yne and 1-ethyl-4-cyclopropyl-butadi-yne.

9. The propellant of claim 7 where $R^1$ and $R^2$ are the same or different and represent a cycloalkyl group having from 3 to 4 carbon atoms.

10. The propellant of claim 9 wherein said compound is selected from the group consisting of 1,4-dicyclopropyl-1,3-butadiyne, 1-cyclobutyl-4-cyclopropyl-1,3-butadiyne and 1,4-dicyclobutyl-1,3-butadi-yne.

11. The propellant of claim 7 wherein said fuel composition further comprises a fuel selected from the group consisting of saturated hydrocarbons, unsaturated hydrocarbons, alcohols, organoamines, hydrazines and combinations thereof.

12. The propellant of claim 11 wherein said fuel composition further comprises a fuel selected from the group consisting of hexane, heptane, octane, decane, gasoline, kerosene, ethylene, propylene, butadiene, methanol, ethanol, propanol, and combinations thereof.

13. The propellant of claim 7 wherein said propellant has an oxidizer-to-fuel ratio in the range of about 2:1 to 10:1.

14. The propellant of claim 7 wherein said fuel composition comprises from about 40 percent to 100 percent by weight of the compound represented by formula (I).

15. A method for producing a propellant comprising contacting a fuel with an oxidizer wherein said fuel comprises a compound represented by the formula (I):

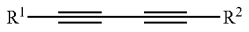

(I)

where $R^1$ and $R^2$ are the same or different and represent an alkyl group having from 1 to 5 carbon atoms, provided at least one of $R^1$ and $R^2$ represents a cycloalkyl group having from 3 to 4 carbon atoms and the oxidizer is selected from the group consisting of nitrogen tetroxide and inhibited red fuming nitric acid wherein the fuel is hypergolic with the oxidizer.

16. The method of claim 15 wherein said compound is selected from the group consisting of: 1-methyl-4-cyclopropyl-butadi-yne and 1-ethyl-4-cyclopropyl-butadi-yne.

17. The method of claim 15 wherein $R^1$ and $R^2$ are the same or different and represent an alkyl group having from 3 to 4 carbon atoms.

18. The method of claim 17 wherein said compound is selected from the group consisting of 1,4-dicyclopropyl-1,3-butadiyne, 1-cyclobutyl-4-cyclopropyl-1,3-butadiyne, and 1,4-dicyclobutyl-1,3-butadi-yne.

19. The method of claim 15 wherein said fuel further comprises a fuel selected from the group consisting of saturated hydrocarbons, unsaturated hydrocarbons, alcohols, organoamines, hydrazines and combinations thereof.

20. The method of claim 15 wherein said fuel comprises about 40 percent to 100 percent by weight of the compound represented by formula (I).

21. The method of claim 15 wherein said propellant has an oxidizer-to-fuel ratio in the range of about 2:1 to 10:1.

22. The fuel composition of claim 1 wherein the fuel composition comprises from about 40 percent to about 80 percent by weight of the compound represented by formula (I).

23. The fuel composition of claim 22 wherein the compound is selected from the group consisting of 1,4-dicyclopropyl-1,3-butadiyne, 1-cyclobutyl-4-cyclopropyl-1,3-butadiyne, and 1,4-dicyclobutyl-1,3-butadi-yne.

24. The fuel composition of claim 23 wherein the fuel is selected from the group consisting of kerosene and exo-tetrahydro-dicyclopentadiene.

* * * * *